US007134247B2

(12) United States Patent
Ting

(10) Patent No.: US 7,134,247 B2
(45) Date of Patent: Nov. 14, 2006

(54) ENHANCED CURTAIN WALL SYSTEM

(75) Inventor: Raymond M. L. Ting, Ross Township, Allegheny County, PA (US)

(73) Assignee: Advanced Building Systems, Inc., Wilmington, DE (US)

( * ) Notice: Subject to any disclaimer, the term of this patent is extended or adjusted under 35 U.S.C. 154(b) by 0 days.

(21) Appl. No.: 10/280,428

(22) Filed: Oct. 25, 2002

(65) Prior Publication Data

US 2003/0041538 A1 Mar. 6, 2003

Related U.S. Application Data

(63) Continuation of application No. PCT/US00/11692, filed on Apr. 26, 2000, which is a continuation-in-part of application No. 08/887,879, filed on Jul. 3, 1997, now Pat. No. 6,393,778.

(51) Int. Cl.
*E04H 9/00* (2006.01)
*E04H 9/16* (2006.01)

(52) U.S. Cl. ..... 52/235; 52/234; 52/302.1; 52/506.01

(58) Field of Classification Search ..... 52/235, 52/234, 302.1, 302.3, 390, 506.01, 506.04, 52/490, 580
See application file for complete search history.

(56) References Cited

U.S. PATENT DOCUMENTS 3,062,339 A * 11/1962 Geyser ..... 52/235
3,859,754 A 1/1975 Budich et al.
4,040,219 A 8/1977 Budich
4,086,727 A 5/1978 Kuyper et al.
4,229,905 A 10/1980 Rush
4,561,225 A * 12/1985 Gartner ..... 52/220
4,597,235 A * 7/1986 Olsen ..... 52/509
4,598,513 A 7/1986 Gartner
4,599,838 A * 7/1986 Kaminaga ..... 52/235
4,619,092 A * 10/1986 Kaminaga ..... 52/235
4,625,482 A * 12/1986 Kaminaga ..... 52/235
4,662,145 A * 5/1987 Tanikawa et al. ..... 52/745.1
4,685,263 A * 8/1987 Ting ..... 52/235

(Continued)

FOREIGN PATENT DOCUMENTS

JP 331933 * 12/1993 ..... 52/235

(Continued)

OTHER PUBLICATIONS

"Wausau Guide Specifications: 5" Barrier Structural Glazed Window System", Model 6250 Guide Specifications and related drawings from Product Specification, published by Wausau Metals Corporation, 10 pages.

(Continued)

*Primary Examiner*—Phi Dieu Tran A
(74) *Attorney, Agent, or Firm*—The Webb Law Firm

(57) ABSTRACT

When assembled to a building support structure to form a curtain wall system of adjoining panels, a preferred embodiment of the enhanced airloop wall system as shown in FIG. 2 comprises panel frame segments that, when assembled, form interconnected inner and outer airloop segments that separate and improve water seal and air seal functions and improve sealing performance, a circuitous path (e.g., "A") at an enlarged air opening into an airloop to pressure equalize and limit water entry into the airloop, a two point fastener support of each panel assembly to allow interfloor deflections under seismic or other loads without excessive loads on the panel assembly, a structural hook-like protrusion for resisting building outward loads on panels separate from fasteners, a splitter in a drainage cavity in the outer airloop that creates a dual drainage path and a surface upon which droplets can collect.

37 Claims, 3 Drawing Sheets

U.S. PATENT DOCUMENTS

| | | | | | |
|---|---|---|---|---|---|
| 4,704,839 | A | | 11/1987 | Kay | |
| 4,809,475 | A | * | 3/1989 | Emmer | 52/235 |
| 4,819,405 | A | | 4/1989 | Jackson | |
| 4,821,475 | A | | 4/1989 | Kondo et al. | |
| 4,840,004 | A | | 6/1989 | Ting | |
| 4,852,312 | A | | 8/1989 | Harbom | |
| 4,894,973 | A | | 1/1990 | Over | |
| 4,949,506 | A | | 8/1990 | Durham, Jr. | |
| 4,958,468 | A | | 9/1990 | Nolan | |
| 5,083,405 | A | * | 1/1992 | Miller | 52/235 |
| 5,235,790 | A | * | 8/1993 | Ishikawa et al. | 52/235 |
| 5,325,579 | A | | 7/1994 | Baier | |
| 5,452,552 | A | * | 9/1995 | Ting | 52/235 |
| 5,555,682 | A | | 9/1996 | Colitto | |
| 5,596,851 | A | | 1/1997 | Ting | |
| 5,598,671 | A | * | 2/1997 | Ting | 52/235 |
| 5,598,672 | A | * | 2/1997 | Nawa | 52/235 |
| 5,647,179 | A | * | 7/1997 | Hayashi et al. | 52/235 |
| 5,685,263 | A | | 11/1997 | Bahm et al. | |
| 5,687,524 | A | | 11/1997 | Ting | |
| 5,768,836 | A | | 6/1998 | Bachmann | |
| 6,393,778 | B1 | | 5/2002 | Ting | |
| 6,442,907 | B1 | * | 9/2002 | Doyon et al. | 52/235 |

FOREIGN PATENT DOCUMENTS

| | | | | |
|---|---|---|---|---|
| JP | 102651 | * | 4/1998 | 52/204.1 |

OTHER PUBLICATIONS

"1600 Wall Screw Spline Specifications", Pictorial View Details, from Product Specification published by Kawneer Co., Inc., 1987-1989, 3 pages.

"Ounce of Prevention", Pittsburgh Business Times, Dec. 17, 1999, 1 page.

"Ting Wall, A Revolution in Curtainwall Technology", published by Advanced Building Systems, Inc., 2000, 12 pages.

Keleher, Richard, "Rain Screen Cladding, Air Barriers, and Curtain Walls", The Construction Specifier, Feb. 2000, pp. 37-40.

"Curtainwall Window Wall Systems", YCW 750 Product Specifications and pictorial view, published by YKK AP America, Inc., Jan. 1, 1994, pp. E1-18 to E1-24 and E1-1 to E1-3.

* cited by examiner

ENHANCED CURTAIN WALL SYSTEM

CROSS-REFERENCE TO RELATED APPLICATIONS

That this application is a continuation of PCT Application No. PCT/US00/11692 filed Apr. 26, 2000, and designating inter alia the United States, which is a continuation-in-part of parent U.S. application Ser. No. 08/887,879, filed Jul. 3, 1997, now U.S. Pat. No. 6,393,778.

BACKGROUND OF THE INVENTION

1. Field of the Invention

This invention relates to curtain wall systems, specifically an improvement on curtain wall systems utilizing multiple framed panels with various facing materials, e.g., as described by Ting in U.S. Pat. Nos. 5,452,552 and 5,598,671. The structure disclosed in U.S. Pat. No. 5,452,552 is also known as an exposed frame airloop curtain wall system and the structure disclosed in U.S. Pat. No. 5,598,671 is also known as a hidden frame airloop curtain wall system.

2. Description of the Prior Art

In addition to providing an aesthetic appearance for the sides of a modern multi-story building, some of the major performance objectives of a curtain wall system of supported panels are as follows:

(1) to provide a barrier or at least resistance to excessive amounts of exterior air infiltrating around the edges of panels into one or more interior environments within the building;

(2) to provide a barrier or at least resistance to excessive amounts of exterior rain or other exterior liquids/particles infiltrating around the panel edges into one or more interior spaces within the building, typically when the liquids or particles tend to infiltrate in conjunction with air infiltration;

(3) to provide resistance to structural loads, specifically including supporting the weight of the panels and resisting seismic loads, wind loads, and thermal expansion/contraction loads, if any; and (4) to provide a thermal barrier or at least resistance to excessive heat transfer between the exterior air and one or more interior environments.

The two aforementioned U.S. Patents are primarily directed to solving problems with excessive air and water infiltration or leakage using an airloop system. Previous designs dealing with water leakage typically required a nearly perfect seal to stop excessive air and water infiltration. The aforementioned U.S. Patents describe a pressure equalized airloop having two seals that separate the functions of sealing water and air, providing acceptable air and water infiltration rates even with imperfect seals. In addition, one embodiment of the airloop system allows panels to be shop assembled with perimeter panel frame extrusions so that a more reliable seal can be fabricated and a pressure equalized inner airloop is formed along the facing panel frame edges. A pressure equalized outer airloop is formed after field erection of the panels with bordering panel frames.

However, the prior airloop systems described can still allow, e.g., under extreme dynamic wind conditions, rain water to get to the air seal. Since the air seal in the airloop system can be assumed to be imperfect, water leakage can occur. In addition, the panel securing fasteners in the airloop systems described in U.S. Pat. Nos. 5,452,552 and 5,598,671 would be put in tension under negative wind load conditions (e.g., winds and/or wind loads directed away from the building interior on one side of the building) such that the connection strength and seal compression may be reduced. Still further, repeated negative wind loads could cause the securing screws to become loosened or stretched, causing the danger of one or more panels to fall off the building.

In addition, the panel frames may not provide the desired thermal insulation for some applications. Still further, seismic and other loads may tend to crack or loosen panels and damage seals if the building structure is even slightly deformed. Thus, although significant advancements have been made in achieving some objectives for a curtain wall system, specifically including the two aforementioned patents, an improved system is still needed.

SUMMARY OF THE INVENTION

The objective of the enhanced curtain wall system is to improve the performance of airloop curtain wall systems in one of more of the following areas: air/water infiltration resistance, structural performance under negative wind load conditions, and thermal insulation performance. The enhanced curtain wall system achieves the objective by providing one or more of the following features: an inner airloop and an outer airloop that separates water and air seal functions, water draining functions and sealing functions, a circuitous path at an air entry opening to limit water entry into at least one of the airloops, an air entry opening sufficiently large to equalize the pressure in an airloop with the exterior environment, a two point support of each panel assembly combined with sliding seals and a clearance dimension to allow interfloor side sway deflections under seismic or other loads without causing significant stress in the panel assembly, a structural engagement with a mullion for resisting outward wind loads on panels limiting outward loads on fasteners, a splitter in a drainage cavity in the outer airloop that creates a dual drainage path and a surface upon which droplets can collect, thermal breaks in the panel frame to increase the resistance to heat transfer between the building interior and the exterior environment, and clip-on insert members to allow easier panel assembly installation and removal.

BRIEF DESCRIPTION OF THE DRAWINGS

In these Figures, it is to be understood that like reference numerals refer to like elements or features.

DESCRIPTION OF THE PREFERRED EMBODIMENT(S)

In order to better explain the working principles of the invention, the following terminology will be used herein:

a curtain wall panel or panel assembly: one of a plurality of panels or panel assemblies having a building facing or curtain wall element of a building secured and nominally sealed to a panel frame, typically a perimeter portion of the facing element is shop secured and sealed to segments of the panel frame;

an inner airloop: an air space substantially forming a loop around and near the perimeter edges of the facing elements and generally within the panel frame;

an outer airloop: an air space substantially forming a loop around each facing element proximate to the inner airloop;

a water seal: a sealant line in an exterior water path towards an interior space within the building that is used to restrict water infiltration when little or no differential air pressure is present across the sealant line; and an air seal: a sealant line inboard and away from an exterior water path that is used to restrict air infiltration into the building.

Figure 1:
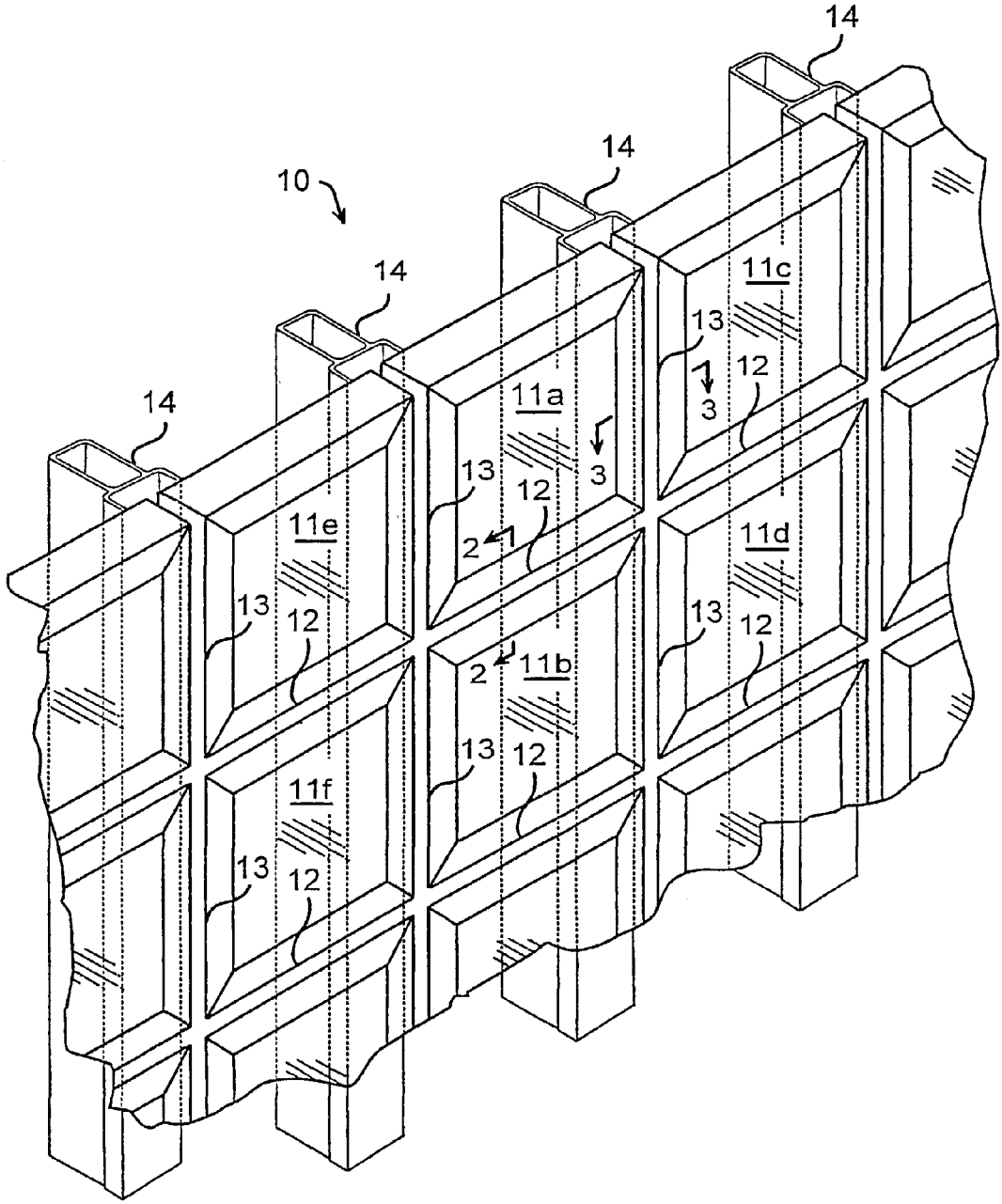
FIG. 1 is an isometric view of an exterior wall system portion including an embodiment of the improved airloop wall system.

FIG. 1 illustrates an embodiment of the enhanced airloop curtain wall system 10 comprising an assembly of multiple curtain wall panels (e.g., panels 11*a* through 11*f*) that are supported by structural members or spaced-apart vertical mullions 14 of a building (not shown for clarity). Although FIG. 1 shows an embodiment of an enhanced curtain wall system 10 in which a facing or curtain wall element of each curtain wall panel 11*a* through 11*f* is composed of insulated, dual glass segments, the enhanced curtain wall system can also comprise other solid materials as facing elements. And although the curtain wall panels 11*a* through 11*f* are shown in FIG. 1 as generally square, substantially flat panel assemblies, other assembly shapes of panels may also be used. But however the individual panels are shaped, multiple panels must be joined together to form a portion of the curtain wall of the building.

Two types of wall joints are typically formed between adjacent curtain wall panels, namely nominally horizontal wall joints 12 (e.g., between facing panels 11*a* and 11*b*) and nominally vertical wall joints 13 (e.g., between facing panels 11*a* and 11*c*). However, many other types of wall joints can be formed and used, e.g., non-linear joints, linear joints oriented at a diagonal or other direction, or joints made to accommodate wall protrusions or irregular panel boundary geometries.

Figure 2:
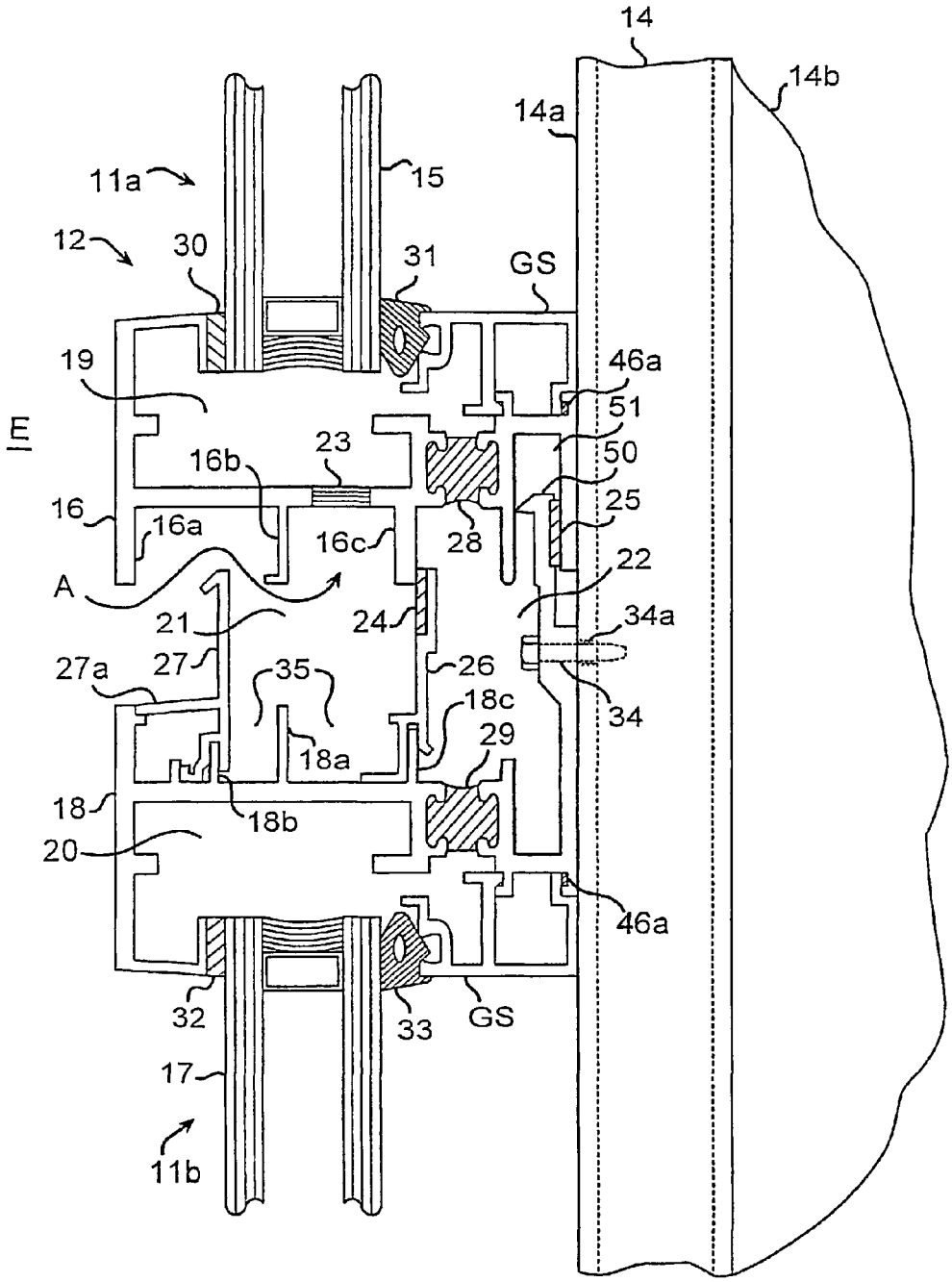
FIG. 2 is a partial cross-sectional view taken along line 2—2 of FIG. 1 showing a horizontal wall joint of an embodiment of the improved airloop wall system.

FIG. 2 shows a typical fragmentary cross-section of one embodiment of a horizontal wall joint 12 located between panels 11*a* and 11*b*, the cross section taken along line 2—2 as shown in FIG. 1. The upper facing panel 15 is attached near its lower edge to a lower frame segment 16 forming a portion of the glass panel 11*a*. The horizontal wall joint 12 shown is formed between the lower frame segment 16 and an upper frame segment 18 connected to the upper portion of lower facing panel 17 forming a portion of a lower panel assembly 11*b*. The two panel assemblies 11*a* and 11*b* are typically located on the exterior of an associated building and each attached to the building/building structure using a pair of fasteners 34 such that each panel is supported by two spaced-apart vertical mullions 14. The lower frame segment 16 is typically shop assembled to the upper facing panel 15 and the upper frame segment 18 is typically shop assembled to the lower facing panel 17.

Although frame segments such as lower frame segment 16 are preferably aluminum extrusions, alternative frame segments may also be fabricated using different fabricating means and from many other materials. Other fabrication means and/or other materials of construction can include other metals, elastomerics, injection molded plastics, and composites.

Figure 3:
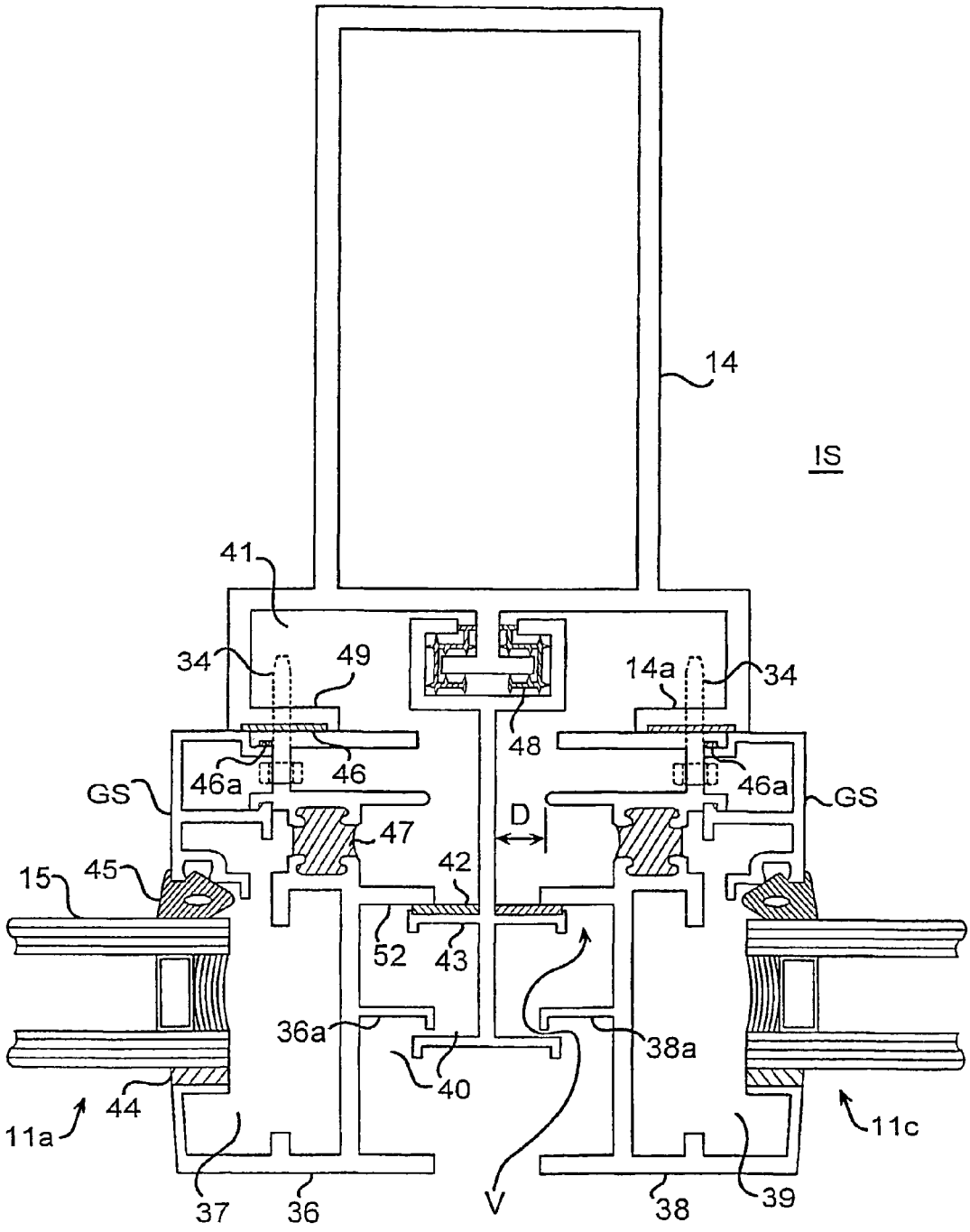
FIG. 3 is a partial cross-sectional view taken along line 3—3 of FIG. 1 showing a vertical wall joint of an embodiment of the improved airloop wall system.

The upper frame segment 18 is shown in FIG. 2 as attached to one or more vertical mullions 14 or other supporting structure associated with a building using one or more screws 34, but rivets, nuts and bolts, hooks and slots, clamps, or other means for attaching can also be used. The screws 34 preferably form a 2 "point" attachment attaching each end (or locations/points near each end) of the upper frame segment 18 to two different L-shaped attaching flanges 14*a* (a portion of one flange 14*a* is shown dotted in FIG. 2 and a flange 14*a* is also shown in FIG. 3) that protrude generally outward from a main box-shaped supporting structure 14*b* of the vertical mullion 14. Other supporting structure shapes are also possible including a T-shaped protrusion, an I-shaped protrusion (e.g., where outwardly directed loads would put a fastener in shear instead of in tension), no protrusion (where a fastener would be attached directly to the box-shaped supporting structure or other shaped supporting structure), floor beams, and cross beams.

The preferred two-point fastener attachment of the upper frame segment 18 to the protruding L-shaped flanges 14*a* provides a number of benefits. Since each threaded fastener hole 34*a* in the protruding flange 14*a* does not penetrate into an interior air space of the building (FIG. 3 shows one interior air space IS), a separate air seal for each fastener 34 is not required and air leakage to or from the exterior environment E to an interior space IS (e.g., an air conditioned space) from this potential leakage source is eliminated. The lack of a pressure differential across the threaded fastener hole 34*a* also minimizes water leakage to an interior space IS and any attendant corrosion problems.

Another benefit of the preferred two-point fastener attachment is when other later-described clip-on or otherwise removable components (e.g., such as a water seal member 26 and a rain screen member 27) are detached, the screws 34 are easily accessed for removal, maintenance or repair/replacement of a panel. Initial installation of the screws 34 prior to installing clip-on components is also simplified, allowing the enhanced curtain wall system to be substantially erected from inside the building without scaffolding, e.g., reaching from interior space IS shown in FIG. 3 through uninstalled upper panel spaces to the exterior portions of the upper frame segments 18 to be attached to the mullions 14.

Still another benefit of the preferred two-point fastener attachment and clearance dimension D (shown in FIG. 3) is that the orientation of the two screws 34 allows the attached frame segments to move as a pinned bar linkage under interfloor deformation loads, e.g., to move without damage under a deflecting seismic load in a lateral direction having a horizontal component in the plane of the panel 11*a*. In other words, relative motion of the support points (or motion of screw holes 34*a* in protruding flanges 14*a*) in a horizontal direction between mullions 14 are accommodated by the lower frame segment 16 sliding on air/water seals 24 and 25 without significant stress or strain on the glass facing element 15 or other panel components. Some relative motion of both support points in a horizontal direction perpendicular to the direction between vertical mullions 14 can also somewhat be accommodated without undue stress or strain on the panels, e.g., the lower portion of the panel assembly 11*a* can pivot on seals 24 and 25 and/or swing slightly inward and outward to or away from the vertical mullions 14. Compared to other securing/attachment methods, significantly reduced loads on the facing element 15 and air/water seals (e.g., 24 & 25) are accomplished during strong seismic loads that cause lateral deflections in mullions 14. And because of the ability of the enhanced airloop system (e.g., as described herein and in co-pending U.S. patent application Ser. No. 08/887,879) to function as a water barrier to the exterior environment without perfect seals, the resistance to water leakage tends to be maintained after a seismic event even if the air/water seals 24 and 25 are damaged.

In the preferred embodiment, the design clearance D of the invention (shown in FIG. 3) allows relative panel motion during horizontal inter-floor deflections or side sway motion, e.g., due to wind or seismic loads on the building. Design clearance D is provided between a mullion 14 and the vertical edge of a panel near the bottom of a panel. Allowable interfloor lateral or side-sway motion (e.g., during a seismic event) for a typical high rise building is in the order of about L/200, where L is the distance or height between floors. For example, for an interfloor height of 12 feet, the building structure is designed to allow an interfloor side-sway (under extreme loads) of about ¾ inch. Thus, a 6-foot square panel could be exposed to side-sway support deflections of about ⅜ inch. The design clearance D is typically selected to accommodate the extreme deflection of a panel, in this example at least about ⅜ inch, but design clearance D may be as much as ¾ inch or more. Design clearance D may also be as little as ¼ inch or less if a stiffer building structure is designed, or some damage at these extreme deflections can be accepted, or smaller panels are used.

In addition to the design clearance D, each panel frame is fastened to the mullions 14 near the two top corners (in upper frame element 18) with motion-capable or motion-accepting attachment (e.g., fasteners) and seals. As shown in FIGS. 2 and 3, the lower frame segment 16 can move relative to the joint spline 50 in the horizontal direction within the design clearance D without hitting the mullion 14 during side sway events. Therefore, the building side sway motion (within clearance "D" limits) is absorbed by the system without causing damaging stresses in the curtain wall panels. To maintain an acceptable sealing function over time while allowing some freedom of relative movement between the panel frame and the support frame (e.g., mullion 14), it is preferred to use a dry type of seal or other material having a seal coating material for seal 46, such as a resilient foam, an elastomer such as Teflon, or a molybdenum disulfide powder. However, other types of motion-capable or motion-accepting seals may also be used such as lubricated elastomeric seals, grease, putty or other gap fillers, and resilient adhesives.

As shown in FIG. 2, an air space 20 is formed generally within bottom panel 11*b* and is generally adjacent to an upper edge of the bottom facing element 17. The air space 20 is the top segment of an inner airloop around the bottom panel 11*b*. The top frame segment 18 of the bottom panel 11*a* is similar to the top frame segment of panel 11*a* (not shown in FIG. 2 for clarity) and is also typically similar to the lower frame segment 16, allowing mitered ends of each protrusion or portion of the top frame segment to be attached to one or more common side frame segments 36 or 38 (as shown in FIG. 3) to form a substantially continuous inner airloop around each panel.

One or more air holes or openings 23 in the lower frame segment 16 serve a primary purpose of air entry, but may also serve other purposes. The air opening or openings 23 are typically sized to allow a flow of air into the inner airloop such that pressure within the inner airloop (including inner airloop segments 19 and 20) is substantially equal to the air pressure of the exterior or building external environment E. In other words, the air openings 23 are typically sized such that a "worst case" flow of air through the air openings will not cause a significant pressure drop across the air openings, e.g., a maximum pressure drop across the air openings of about 0.1 inches of water, more typically less than 0.05 inches of water, and preferably even less than 0.03 inches of water under worst case flow of air.

A worst case flow of air into the inner airloop through air openings 23 is typically caused by a combination of environmental, design, and scaling factors, the most important of which is typically air leakage past an imperfect facing element air seal 31. The most likely area of seal imperfection is at the mitered corners of the air seal 31 and various estimates (or actual test data) can be used to approximate air leakage at the air seal/panel assembly corners under various conditions of differential pressure across an imperfect air seal. Another potential leakage path is around the glazing stops GS. As an option to reduce air infiltration around glazing stops GS, an auxiliary seal 46*a* such as caulking is placed between the panel frame segments 16 & 18 and the glazing stops. Other factors tending to cause air inflow into the inner airloop include water (possibly including condensation) draining out on the inner airloop, other seal imperfections, rapidly increasing barometric pressure in the exterior environment, and rapid thermal expansion of the inner airloop. As an example of sizing an air opening 23, auxiliary and/or air seal ends or imperfections at the four mitered end joints can be estimated to each be the equivalent of circular openings about 5 square millimeters and that air leakage past these seal imperfections or corners is the major cause of air entering or leaving the air openings 23. In order to minimize any pressure drop across the air openings, one method is to size the air openings at least about 20 times as large as than the equivalent seal imperfections, or having at least about 100 square millimeters or one air opening preferably having a diameter of at least about ⅜ inch, more preferably having a diameter of at least about ½ inch. In order to provide for other air flow factors, water drainage, and to further assure that pressure is safely equalized within the inner airloop, the most preferred embodiment includes three air openings 23 having a diameter of at least about ⅜ inch.

Because another purpose of at least one of the air openings 23 is to allow rain or other water to drain out of (perhaps concurrently with air entering) the inner airloop, at least one of the air openings should be in the lower frame segment 16 as shown in FIG. 2 and be at least about ⅛ inch in diameter, preferably at least about ¼ inch in diameter. However, the preferred location of at least one air opening 23 is near the center of the lower frame segment 16 to provide for the primary air flow purpose (i.e., away from draining water paths proximate to side frame segments 36 and 38 shown in FIG. 3). Other air openings 23 can be provided in other frame segments or locations to further assure that air pressure within the inner airloop is substantially equal to pressure in the exterior environment E. In an alternative embodiment, one or more of the portions of the inner airloop may be discontinuous (e.g., for lower building edge panels) and additional air openings (e.g., located near the lower portion of the side segments of the inner airloop) may be needed for air entry and/or to drain water from the inner airloop. In an alternative embodiment, at least two of the air holes are located in the lower frame segment 16 near each mitered corner of the panel. This dual corner location of air openings 23 allows water to easily drain from at least one air opening 23 at one end and air to enter the other air opening 23. Putting a preferred third air opening 23 between the dual corner located air openings in lower frame segment 16 or on another lower frame segment allows water to easily drain from both ends (e.g., water entering from imperfect water seals in the side or vertical segments) and sufficient air flow to enter through the third or middle air opening 23 to substantially equalize the air pressure within the inner airloop to about the air pressure in the exterior environment E.

Also in the preferred embodiment, air from the exterior environment E is forced around an exterior protrusion or first baffle 16*a*, a clip-on rain screen or baffle member 27, and the second or L-shaped baffle or protrusion 16*b* prior to entering the air opening 23 as shown by tortuous or circuitous path arrow "A" in FIG. 2. The rain screen member 27 and protrusions 16*a* and 16*b* form alternating path baffles that preclude a straight path flow of air (with possibly entrained water) from the exterior environment E to the air opening 23. In addition, the alternating path baffles provide surfaces on which entrained water or particulates tend to impact since the less dense air can change flow direction more easily around the baffles than the more dense water droplets and particulates which tend to be "thrown" outward onto the alternating path baffles and collect thereon. The baffle-collected water droplets tend to coalesce and drain outward (e.g., on drain surface 27*a*) towards the exterior environment E and/or downward towards rain gutters 35, also carrying particulates with the draining water.

Although the L-shaped baffle protrusion 16*b* is preferred at or near one of the air openings 23 as shown (e.g., the L-shape tends to increase the circuitousness of the air path "A"), the L-shaped baffle protrusion is essentially a continuation of side ribs 36*a* and 38*a* (see FIG. 3) and upper rib 18*a* protruding from the upper frame segment 18 which are not shown as L-shaped. Portions of the L-shaped protrusion 16*b* that are spaced-apart from an air opening 23 may not be required to be L-shaped since little or no air is entering at a spaced-apart distance from the air opening. A straight upper protrusion 18*a* is therefore shown in the preferred embodiment. If only a portion of the lower protrusion 16*b* is L-shaped near the air opening 23 and the remainder (spaced apart from any air openings) is straight, draining water from the building outward side of the lower protrusion 16*b* will tend to be diverted to the straight protrusion portions, thereby further minimizing water/particulate re-entrainment problems near the air opening 23. In the preferred embodiment, the portion of baffle protrusion 16*b* that is L-shaped extends at least 1/16 inch on either side of air opening 23 and alternating path baffles/protrusions are spaced apart by at least about 1/16 inch, more preferably at least about 1/8 inch, but preferably spaced-apart by no more than about 1/2 inch, and typically protrude into the first joint space 21 by at least about 1/4 inch, more preferably at least about 9/16 inch.

Many other baffle shapes, spacings, and protruding lengths are possible in alternative embodiments. Increased baffle lengths, smaller spacing, and thicker shapes may be needed when even less water entering the air opening 23 is desired, but the opposite may be desired if lower costs and a closer approach to pressure equalization is desired. Although the preferred embodiment uses extruded aluminum for the exterior protrusion 16*a*, the second or L-shaped protrusion 16*b*, and the rain screen member 27, one or more of these components may also be composed of other materials, such as other metals, wire screen, porous materials, and elastomerics. Other materials may have advantages in the areas of increased retaining/draining of impacted water and reducing water/particulate re-entrainment problems.

The rain screen member 27 and the rain seal holder 26 are clipped or otherwise removably attached to tabs 18*b* and 18*c* on upper frame segment 18. This clip-on configuration allows easy installation and removal of the rain screen member 27 and rain seal holder 26 as well as easy access to screws 34 or other attachment means for installation or removal of an entire panel. Although clipped attachment is the preferred attachment means, alternative embodiments can attach screens or seal holders by means of pinned connections, hooks and slots, adhesives, or fasteners.

Air openings 23 in an alternative embodiment may have different shapes and sizes, e.g., several openings primarily sized for air flow having a preferable diameter of at least about 3/8 inch plus a separate drain hole near a water path, e.g., a hole about 1/4 inch in diameter or less near a mitered corner. Other alternative embodiments can include an air hole in most if not all frame segments, air opening slots instead of the circular air opening 23 shown, a screen or filter placed over the air opening 23 to further minimize water entry, and additional baffles placed in or near the air opening 23 or inside lower loop segment or space 19 to still further minimize water entry.

Outside the top loop segment 20 and lower loop segment 19 of the inner airloops, the air space or outer airloop portion within the horizontal wall joint 12 is essentially separated into two sections of an outer airloop, namely the first or wet joint space 21 and the second or dry joint space 22. The first joint space 21 serves concurrently as a drain path (as the bottom segment of the first section of the outer airloop of the top panel 11*a*) and as the top segment of the first section of the outer airloop of the bottom panel 11*b*. The second joint space 22 serves concurrently as the bottom segment of the second section of the outer airloop of the top panel 11*a* and the top segment of the second section of the outer airloop of the bottom panel 11*b*.

The rain or water seal 24 is placed between third protrusion 16*c* of the lower frame segment 16 and interior baffle or rain seal holder 26. The water seal 24 is preferably attached to the rain seal holder 26 and extends for some distance from the ends of upper frame segment 18 and toward the center of the panel 11*a* or 11*b*, but the water seal 24 may not be continuous over the entire width of a panel. In addition, the clipped attachment of the interior baffle 26 to a protrusion 18*c* of the upper panel frame segment 18 may not be sealed against air infiltration. The exterior air can therefore enter into first and second joint spaces 21 and 22 and are both pressure equalized with the air in the exterior environment E, similar to the upper loop segment 20 and lower loop segment 19 of the inner airloop. In other words, air can be transferred between the outer airloop and the inner airloop, equalizing the pressure between the inner airloop pressure and the exterior air pressure, but water is effectively prevented from entering the second joint space 22. In an alternate embodiment, additional air passageways can be provided between the first and section joint spaces 21 and 22 in locations away from drainage paths, if required.

In the preferred embodiment of the enhanced curtain wall system, the panel or facing glass element 17 of the bottom panel 11*b* is nominally sealed to the upper frame segment 18 by a panel water seal 32 and a panel air seal 33. The wall joint 12 between the panels 11*a* and 11*b* is nominally sealed by a frame water seal 24 and a frame air seal 25. Since some or all of the air and water seals may be discontinuous and/or field or site assembled, the chance for bypass, misalignment, dirt, or other causes of leakage may be present and some imperfect seals among the many panels present on larger buildings should typically be assumed. However, as discussed herein and as discussed in co-pending patent application Ser. No. 08/887,879, the invention is tolerant of imperfect seals.

In the preferred embodiment, panel water seals 32 and 30 are closed cell foam sealing tapes such as Norton tapes available from Norton Performance Plastics, now Saint-Gobain Performance Plastics, located in Wayne, N.J. However, alternative embodiments can use other types of seals or water flow restrictors. The preferred panel air seals 33 and 31 are insertable-type gasket seals typically composed of EPDM material. However, alternative embodiments can use other types of seals or airflow restrictors.

In the preferred embodiment, frame water seal 24 and the frame air seal 25 are closed cell foam sealing tapes, such as Norton tapes similar to panel water seals 30 and 32. However, alternative embodiments can use other types of seals or flow restrictors.

In the preferred embodiment, the lower frame segment 16 has a female joint groove 51 that engages a male joint spline 50 protruding from the upper frame segment 18. The mating surfaces of the joint groove 51 and joint spline 50 provide the opposing sealing surfaces of the frame air seal 25. Similarly, the mating surfaces of water seal member 26 and a third or water seal protrusion 16*c* of the lower frame segment 16 provide the sealing surfaces for the frame water seal 24. In alternative embodiments of the enhanced curtain wall system, other joint elements and mating surfaces can be provided.

The gutter spaces 35 within the first section of the outer airloop 21 are used to channel any water (e.g., splashed over the rain screen member 27) to one or both mitered ends where the water can be channeled downward in the vertical frame segments of panel assembly 11*b*. The gutter protrusion 18*a* also serves as an added surface on which water droplets are thrown into as entering air is forced to turn around the L-shaped protrusion 16*b* of lower frame segment 16, e.g., instead of being thrown against frame water seal 24 or rain seal holder 26. The gutter protrusion 18*a* also serves to split the lower portion of the first segment 21 of the outer airloop into two drain channels or gutter spaces 35. The creation of two drain channels 35 tends to reduce water splash/re-entrainment and to provide somewhat more outwardly contained paths for water to drain. Alternative embodiments of the enhanced curtain wall system may delete the gutter protrusion 18*a* creating dual gutter spaces 35 or provide other drain paths.

As an option to improve thermal insulation performance of the inventive curtain wall system, one or more thermal breaks (e.g., the lower thermal break 28 shown in the lower frame segment 16 and the upper thermal break 29 shown in upper frame segment 18) can be used in some or all panel frame segments (16, 18, 36, and 38) and at other locations. Although a low thermal conductivity, plastic material is preferred for the thermal breaks, other substantially rigid materials with sufficient structural strength and limited thermal conductivity can be used for the thermal breaks such as 28 and 29. In addition, the aluminum-plastic interfaces between the thermal breaks 28 & 29 and the frame segments 18 and 16 can be roughened or coated to further reduce thermal conductivity. The thermal breaks 28 and 29 are preferably manufactured or shop assembled into the frame segments 18 and 16 using a pour-and-debridge process, but other manufacturing or assembly methods are also possible, including manual insertion.

The process of erecting or installing panels on the building or building structure typically starts with panels near the bottom of the building and continues with adjacent panels. The water seal support members 26 and the rain screen members 27 are typically shipped separated from the remainder of the panel assembles. A preferred process requires three major steps to install a panel, e.g., first placing the lower portion of the panel into an engaged spline 50/slot 51 position with the previously installed panel below (not shown for clarity in FIG. 2), secondly fastening only the upper frame segment 18 to secure the panel (e.g., panel 11*b*) to two adjacent mullions 14 using fasteners 34, and then thirdly placing/engaging/clipping water seal/rain screen members 26 & 27 into place on the upper frame segment 18. After the three major steps, an adjoining panel (e.g., panel 11*a*) is ready to be placed into the engaged position as shown in FIG. 1.

FIG. 3 shows a typical fragmentary cross-section of a vertical wall joint 13 between panels 11*a* and 11*c* taken along line 3—3 as shown in FIG. 1. The vertical wall joint 13 is formed when the left side panel 11*a* and the right side panel 11*c* are typically installed in the field (i.e., attached to the building or building's structural members).

The right frame member 36 is the right vertical segment of the panel frame segments of panel assembly 11*a*. The right air space 37 is the right vertical segment of the inner airloop of the panel assembly 11*a*. The left frame member 38 is the left vertical segment of the panel frame of the right panel assembly 11*c*. The left air space 39 is the left vertical segment of the inner airloop of the panel assembly 11*c*. The left vertical segment of the panel frame of the panel assembly 11*a* is typically identical to the left frame member 38 and the right vertical segment of the panel frame of the panel assembly 11*c* is typically identical to the right frame member 36. However, alternative embodiments of the enhanced curtain wall system can use non-identical or other frame members.

Although the following discussion is substantially directed to the left side panel assembly 11*c* to avoid significant duplication when discussing the right side panel assembly 11*a*, the space inside the vertical joint 13 is typically symmetrically separated into left and right compartments or sections, namely, the first vertical joint space 40 and the second vertical joint space 41. The first joint space 40 serves as the right vertical segment of the first section of the outer airloop of the panel vertical assembly 11*a*. The second vertical joint space 41 serves as the right vertical segment of the second section of the outer airloop of the panel assembly 11*a*. The vertical water seal 42 portion is attached to the vertical water seal member 43 and is placed to form a potentially continuous water seal (see FIG. 2 for another portion of water seal 24). In an alternative embodiment, the vertical seal member 43 is a protrusion from mullion 14. Other alternative embodiments of the vertical water seal 42 are also possible. Because of the circuitous path V shown in FIG. 3, exterior environment air must take a tortuous path to reach the vertical water seal 42 and the lack of a significant pressure differential across the vertical water seal, resistance to water leakage is improved even if the water seals are discontinuous or imperfect.

The glass facing element 15 of the panel 11*a* is sealed to the vertical frame segment 36 by vertical panel water seal 44 (sealing against the vertical panel frame segment 36) and vertical panel air seal 45 (sealing against a glazing stop GS attached to the vertical panel frame 36), nominally forming continuous air and water panel seals with the air and water panel seals 30–33 shown in FIG. 2. The panel seals (e.g., vertical panel water and air seals 44 & 45) and glazing stops GS are typically factory installed, tending to decrease seal imperfections due to uncontrolled field conditions. As an option to improve air and water infiltration resistance, an auxiliary seal 46*a* is placed between the vertical panel frame 36 and the clipped-on glazing stop GS. As another design option to improve thermal insulation performance, vertical thermal break 47 can be manufactured or assembled in the panel frame members 36 similar to the thermal breaks 28 & 29 shown in FIG. 2, e.g. by the pour-and-debridge process. As a design option to further improve thermal insulation performance, the mullion 14 can be assembled from two extrusions (14 and 43) separated by a thermal break 48. In an alternative embodiment, the mullion 14 is essentially a single extrusion (having a shape similar to extrusions 14 and 43 shown) and incorporating a thermal break (similar to thermal break 43) manufactured by the pour-and-debridge process. In a preferred embodiment, both sides of the panel-supporting flange 49 of the mullion 14 are within the outer airloop space 41 as shown. In this arrangement, the opening created by the fastener 34 will not produce air leakage since it does not penetrate into the building interior space. This lack of penetration improves the airtightness of the enhanced curtain wall, which also improves the thermal insulation and water leakage performance.

The functions of vertical air seal 46 are similar to air seal 25 shown in FIG. 2. And similar to air seal 25, the vertical air seal 46 is spaced apart from vertical water seal 42. Spacing and other dimensions of the elements of vertical joint 13 can be altered in other embodiments, similar to the discussions related to comparable horizontal joint elements. And again, the multi-cavity airloop systems separates the functions of water and air sealing such that the inventive curtain wall system is more tolerant of imperfect seals.

As shown in FIGS. 2 and 3, a preferred embodiment can also achieve the following performance improvements:

The invention simplifies the formation of continuous airloops, seals, and thermal breaks. Several essentially continuous airloops and nominally continuous seals can be easily formed by miter-matching similar vertical and horizontal frame segments. In addition, thermal breaks can also be miter-matched to maintain the continuity of the thermal break function. Although protruding portions of frame segments can have different functions (or little or no function) at different locations around the airloop, the similar structure for each segment simplifies erection, sealing, and the formation of essentially continuous pressure equalized airloops around the panels.

The invention allows improved resistance to negative wind loads. In prior art curtain wall systems, the primary structural resistance against a negative wind load was provided by one or more panel securing fasteners either in tension or in shear resulting in the possibility of fastener failure or loosening due to repeated cyclic loads over time and seal failure. The preferred embodiment of the invention provides a primary structural resistance to negative wind load by the structural engagement of leg 52 (see FIG. 3) of vertical frame 36 with the vertical water seal support member 43 attached to mullion 14 separate from the two-screw fastener 34 attachment. Therefore, the negative wind or other outwardly directed load on panels 11*a* and 11*c* are directly transferred to the mullion 14 (through vertical water seal support member 43) without putting significant or excessive loads on the fastener 34. In an alternative embodiment, a separate load bearing surface can be added to the vertical water seal support member 43 in addition to the vertical water seal 42.

The primary function of the fasteners 34 is now essentially limited to supporting the weight of the panels, resulting in reduced cyclic loading (and possible fastener loosening) with improved long term sealing, structural, and thermal performance. In alternative embodiments of the enhanced curtain wall system, a panel frame protrusion or portion of a panel frame segment hooks on the building interior side of a support structure protrusion or surface, e.g., a panel frame protrusion hooking to the interior surfaces provided for the vertical thermal barrier 48 shown in FIG. 3. Many other hooked or panel retaining shapes and mating surfaces that allow fasteners or other attachment means to function primarily to support the weight of the panels are also possible in alternative embodiments.

The invention also allows improved water tightness of the horizontal and vertical joints 12 & 13. The rain screen 27 and water seal members 26 and 43 (see FIGS. 2 & 3) are utilized to repel most of the exterior water prior to reaching water seals 42 and 24. The small amount of incidental water splashed over rain screen member 27 will flow in the gutter spaces 35 (see FIG. 2) to the vertical joint and drain downward within the space 40. (See FIG. 3.) This drainage occurs within the pressure equalized outer airloop, therefore, there will be no significant water accumulation in the gutter spaces 35 and the drainage action is nearly instantaneous. The horizontal water seal 24 (shown in FIG. 2) may be continuous with (e.g., married to) the vertical water seal 42 (shown in FIG. 3). These seals restrict wind driven rainwater from penetrating into the second air sections 22 (shown in FIG. 2) and 41 (shown in FIG. 3) of the outer airloop. Therefore, the second airloop is a dry loop and air seals 25 (FIG. 2) and 46 (FIG. 3) are therefore not typically exposed to water. Since the inner airloop spaces 19, 20 (FIG. 2) and 37 (FIG. 3) are pressure equalized spaces, the seals 30, 32 (FIG. 2) and 44 FIG. 3) form an effective water seal despite being potentially imperfect because there is no differential air pressure to drive the water across even an imperfect seal. In the case of water seal 30, gravitational force could provide a driving force to push water through water seal 30 if the opening in the water seal 30 were large enough and the amount of water producing a static head sufficient to overcome capillary forces tending to hold the water at the imperfect water seal. However, any water penetrating even a grossly imperfect water seal 30 should be quickly drained into the gutter spaces 35 through an air opening 23. Therefore, there will be essentially no water accumulation in the space 19 and seals 31, 33 (see FIG. 2), and 45 (see FIG. 3) will typically not be exposed to water. Since the air seals, e.g., 31 and 25, are spaced apart from the corresponding water seals around the panels, e.g., 30 and 24, the air and water seal functions are similarly separated and the curtain wall system can tolerate significant sealant line imperfections without causing significant water leakage problems. Moreover, many of the facing element air and water seals may be shop assembled which generally decreases the likelihood of seal imperfections and further improves air and water tightness.

In alternative embodiments, the same design principles can be applied to other curtain wall systems, e.g., to the hidden frame airloop systems disclosed in U.S. Pat. No. 5,598,671. For example, air openings would be similarly sized and placed for the primary purpose of air entry and also for the purpose of water drainage. In other alternative embodiments, protruding structural members, such as an element similar to the vertical water seal member 43, can secure panels against negative wind load (or other building outward loads) essentially limiting loads on the structural attachment means to gravity resisting loads. Structural flanges similar to flange 49 of mullion 14 can provide a panel securing structure that does not need to be sealed against air and/or water leakage.

Although the preferred embodiment of the invention has been shown and described, and some alternative embodiments also shown and/or described, changes and modifications may be made thereto without departing from the invention. Accordingly, it is intended to embrace within the invention all such changes, modifications, and alternative embodiments as fall within the spirit and scope of the appended claims.

The invention claimed is:

1. A wall system, comprising:

a plurality of panels supported vertically on a plurality of wall structural members, the panels each supporting a glass panel and comprising:

an upper facing frame segment;

a lower facing frame segment; and substantially vertical frame segments connecting the upper facing frame segment and lower facing frame segment to form the panel;

wherein the panels are supported on the wall structural members such that the upper facing frame segment of at least one of the panels faces the lower facing frame segment of at least one panel located thereabove;

an air/water seal disposed between the upper and lower facing frame segments;

a pressure-equalization member disposed in the outer air space forward of the air/water seal, the pressure-equalization member connected to and extending between the upper facing frame segment of the lower panel and the lower facing frame segment of the upper panel such that the outer air space between the upper and lower panels is separated into a first outer air space and a second outer air space in fluid communication across the pressure-equalization member, the second outer air space remaining substantially liquid separated from the first outer air space by the pressure-equalization member;

a water seal connected to the pressure-equalization member substantially preventing water intrusion from the first outer air space into the second outer air space;

a rain screen member connected to the upper facing frame segment and extending upward into the first outer airspace; and opposing protrusions extending from the upper and lower facing frame segments and located rearward of the rain screen member;

wherein the glass panel is supported by the upper facing frame segment, the lower facing frame segment, and the substantially vertical frame segments of each panel, and wherein the upper facing frame segment, the lower facing frame segment, and the vertical frame segments of each panel cooperatively define a continuous enclosed internal airloop about the glass panel in fluid communication with the first outer airspace via a vent opening in the lower facing frame segment and defined in the lower facing frame segment immediately forward of the pressure equalization member, and wherein the protrusions are located forward of the vent opening and rearward of the rain screen member in the first outer airspace.

2. The wall system of claim 1, wherein the outer air space is open to the exterior atmosphere, such that the first and second outer air spaces are each maintained at exterior atmospheric pressure.

3. The wall system of claim 1, wherein the water seal is non-continuous along the pressure-equalization member.

4. The wall system of claim 1, wherein the water seal contacts.a lower protrusion on the lower facing frame segment of the upper panel.

5. The wall system of claim 1, wherein the pressure-equalization member is removably mounted on an upper protrusion extending from the upper facing frame segment of the lower panel.

6. The wall system of claim 1, wherein external air flow into the first outer air space must follow a tortuous path into the first outer air space due to the presence of the rain screen member.

7. The wall system of claim 1, wherein the rain screen member and the pressure-equalization member are connected to the upper facing frame segment of the lower panel to define a drain channel therebetween.

8. The wall system of claim 1, wherein the upper facing frame segment for each panel is mounted to at least one of the wall structural members for supporting the respective panels relative to the at least one wall structural member.

9. The wall system of claim 8, wherein the upper facing frame segment is mounted to the at least one wall structural member by at least one mechanical fastener.

10. The wall system of claim 9, wherein the at least one mechanical fastener comprises a pair of mechanical fasteners located substantially at opposite ends of the upper frame segment and engaging the at least one wall structural member.

11. The wall system of claim 9, wherein the at least one wall structural member is configured to form at least in part the second outer air space, such that the at least one mechanical fastener is disposed entirely in the second outer air space.

12. The wall system of claim 8, wherein the upper facing frame segment for each panel includes a protruding flange adapted to accept at least one mechanical fastener used to mount the respective panels to the at least one wall structural member.

13. The wall system of claim 12, wherein the protruding flange of the lower panel engages a corresponding recess defined by the upper panel.

14. A process for installing a plurality of panels supported vertically on a plurality of wall structural members to form a wall system, comprising:

attaching a first panel to at least one wall structural member;

attaching a second panel to at least one wall structural member, the second panel located above the first panel, the first and second panels defining an area therebetween, the first and second panels each supporting a glass panel and comprising:

an upper facing frame segment;

a lower facing frame segment;

substantially vertical frame segments connecting the upper facing and lower facing frame segments to form the panel; and an air/water seal disposed between the upper and lower facing frame segments;

connecting a pressure-equalization member to the upper facing frame segment of the first panel, the pressure-equalization member disposed in the outer air space forward of the air/water seal, the pressure-equalization member connected to and extending between upper facing frame segment of the first panel and the lower facing frame segment of the second panel such that the outer air space between the first and second panels is separated into a first outer air space and a second outer air space in fluid communication across the pressure-equalization member, the second outer air space remaining substantially liquid separated from the first outer air space by the pressure-equalization member, and further comprising a water seal connected to the pressure-equalization member substantially preventing water intrusion from the first outer air space into the second outer air space; and connecting a rain screen member to the upper facing frame segment, the rain screen member extending upward into the first outer air space;

wherein the glass panel is supported by the upper facing frame segment, the lower facing frame segment, and the substantially vertical frame segments of each panel, and wherein the upper facing frame segment, the lower facing frame segment, and the vertical frame segments of each panel cooperatively define a continuous enclosed internal airloop about the glass panel in fluid communication with the first outer airspace via a vent opening in the lower facing frame segment and defined in the lower facing frame segment immediately forward of the pressure equalization member, and wherein opposing protrusions extend from the upper and lower facing frame segments, the opposing protrusions being located rearward of the rain screen member and forward of the vent opening in the first outer air space.

15. The method of claim 14, wherein external air flow into the first outer air space must follow a tortuous path into the first outer air space due to the presence of the rain screen member.

16. The method of claim 14, wherein the steps of attaching the first and second panels to the at least one wall structural member includes mounting the upper facing frame segment of each of the first and second panels to the at least one wall structural member with at least one mechanical fastener.

17. The method of claim 14, wherein the upper facing frame segment for the first and second panels includes a protruding flange, and wherein the protruding flange of the first panel engages a corresponding recess defined by the second panel when the second panel is attached to the at least one wall structural member.

18. A wall system, comprising:

a plurality of panels supported vertically on a plurality of wall structural members, the panels each supporting a glass panel and comprising:

an upper facing frame segment;

a lower facing frame segment; and substantially vertical frame segments connecting the upper facing and lower facing frame segments to form the panel;

wherein the panels are supported on the wall structural members such that the upper facing frame segment of at least one of the panels faces the lower facing frame segment of at least one panel located thereabove, and such that the lower panel is located laterally adjacent at least one other panel;

an air/water seal disposed between the upper and lower facing frame segments;

a pressure-equalization member disposed in the outer air space forward of the air/water seal, the pressure-equalization member connected to and extending between the upper facing frame segment of the lower panel and the lower facing frame segment of the upper panel such that the outer air space between the upper and lower panels is separated into a first outer air space and a second outer air space in fluid communication across the pressure-equalization member, the second outer air space remaining substantially liquid separated from the first outer air space by the pressure-equalization member;

a water seal connected to the pressure-equalization member substantially preventing water intrusion from the first outer air space into the second outer air space;

a vertical member located between the laterally disposed panels and defining a vertical joint space between the laterally disposed panels;

a rain screen member connected to the upper facing frame segment and extending upward into the first outer air space; and opposing protrusions extending from the upper and lower facing frame segments and located rearward of the rain screen member;

wherein the glass panel is supported by the upper facing frame segment, the lower facing frame segment, and the substantially vertical frame segments of each panel, and wherein the upper facing frame segment, the lower facing frame segment, and the vertical frame segments of each panel cooperatively define a continuous enclosed internal airloop about the glass panel in fluid communication with the first outer airspace via a vent opening in the lower facing frame segment and defined in the lower facing frame segment immediately forward of the pressure equalization member, and wherein the protrusions are located forward of the vent opening and rearward of the rain screen member in the first outer air space.

19. The wall system of claim 18, wherein at least part of the vertical joint space is in fluid communication with the first outer air space.

20. The wall system of claim 18, wherein the vertical member extends from one of the wall structural members and includes a water seal engaging at least one of the vertical frame segments of the laterally disposed panels.

21. The wall system of claim 18, wherein the outer air space is open to the exterior atmosphere, such that the first and second outer air spaces are each maintained at exterior atmospheric pressure.

22. The wall system of claim 18, wherein the vertical support member extends from one of the wall structural members and is positioned a preset distance away from the vertical frame segments of the laterally disposed panels to accommodate side-to-side movement of the laterally disposed panels.

23. The wall system of claim 18, wherein the water seal is non-continuous along the pressure-equalization member.

24. The wall system of claim 18, wherein the water seal contacts a lower protrusion on the lower facing frame segment of the upper panel.

25. The wall system of claim 18, wherein external air flow into the first outer air space must follow a tortuous path into the first outer air space due to the presence of the rain screen member.

26. The wall system of claim 18, wherein the rain screen member and the pressure-equalization member are connected to the upper facing frame segment of the lower panel to define a drain channel therebetween.

27. The wall system of claim 18, wherein the upper facing frame segment for each panel is mounted to at least one of the wall structural members for supporting the respective panels relative to the at least one wall structural member.

28. The wall system of claim 27, wherein the upper facing frame segment is mounted to the at least one wall structural member by at least one mechanical fastener.

29. The wall system of claim 28, wherein the at least one mechanical fastener comprises a pair of mechanical fasteners located substantially at opposite ends of the upper frame segment and engaging the at least one wall structural member.

30. The wall system of claim 28, wherein the at least one wall structural member is configured to form, at least in part, the second outer air space, such that the at least one mechanical fastener is disposed entirely in the second outer air space.

31. The wall system of claim 27, wherein the upper facing frame segment for each panel includes a protruding flange adapted to accept at least one mechanical fastener used to mount the respective panels to the at least one wall structural member.

32. The wall system of claim 31, wherein the protruding flange of the lower panel engages a corresponding recess defined by the upper panel.

33. The wall system of claim 18, wherein the vertical member extends between the laterally disposed panels and separates the vertical joint space into a first vertical outer air space and a second vertical outer air space in fluid communication across the vertical member, the second vertical outer air space remaining substantially liquid separated from the first vertical outer air space by the vertical member.

34. The wall system of claim 33, wherein the first vertical outer air space is continuous with the first outer air space and the second vertical outer air space is continuous with the second outer air space.

35. The wall system of claim 33, wherein the water seal contacts a lower protrusion on the lower facing frame segment of the upper panel, and the vertical member includes a water seal contacting at least one of the vertical frame segments and is continuous with the water seal connected to the pressure-equalization member.

36. The wall system of claim 35, wherein the water seal connected to the pressure-equalization member is non-continuous along the pressure-equalization member.

37. The wall system of claim 33, wherein the vertical frame segments of the laterally disposed panels overlap the vertical member.

* * * * *